US009017226B2

(12) United States Patent
Nash

(10) Patent No.: US 9,017,226 B2
(45) Date of Patent: Apr. 28, 2015

(54) ATTENDANT-ASSISTING BABY WALKER

(71) Applicant: Jeffrey Nash, Las Vegas, NV (US)

(72) Inventor: Jeffrey Nash, Las Vegas, NV (US)

( * ) Notice: Subject to any disclaimer, the term of this patent is extended or adjusted under 35 U.S.C. 154(b) by 189 days.

(21) Appl. No.: 13/936,454

(22) Filed: Jul. 8, 2013

(65) Prior Publication Data

US 2015/0014374 A1 Jan. 15, 2015

Related U.S. Application Data

(63) Continuation-in-part of application No. 12/905,050, filed on Oct. 14, 2010, now abandoned.

(60) Provisional application No. 61/251,745, filed on Oct. 15, 2009.

(51) Int. Cl.

| | |
|---|---|
| ***A47D 13/04*** | (2006.01) |
| ***A47D 13/08*** | (2006.01) |
| ***A61H 3/00*** | (2006.01) |
| ***A63B 22/00*** | (2006.01) |
| ***G09B 19/00*** | (2006.01) |

(52) U.S. Cl.

CPC ..... *A47D 13/086* (2013.01)

(58) Field of Classification Search

CPC ..... A47D 13/04; A47D 13/046; A47D 13/08; A47D 13/086; A63B 69/0028; A63B 69/0035; A63B 2069/0037; A63B 2208/0204; A63B 2208/12

See application file for complete search history.

(56) References Cited

U.S. PATENT DOCUMENTS

| | | | |
|---|---|---|---|
| 1,749,999 | A | 3/1930 | Crocker |
| 2,719,568 | A | 10/1955 | Webb |
| 3,730,587 | A | 5/1973 | Bloxham et al. |
| 3,992,040 | A | 11/1976 | Gannac |
| 4,197,816 | A | 4/1980 | Lusch |
| D290,765 | S | 7/1987 | Callahan |
| 4,905,989 | A | 3/1990 | Colvin |
| 4,907,972 | A | 3/1990 | Marolda |
| 4,922,860 | A | 5/1990 | Hutchings |
| 4,981,110 | A | 1/1991 | Llewellyn |
| 5,074,795 | A | 12/1991 | Clark |
| 5,120,287 | A | 6/1992 | Brown et al. |
| 5,388,551 | A | 2/1995 | Martusciello |
| 5,435,272 | A | 7/1995 | Epstein |
| 5,476,070 | A | 12/1995 | Gwon et al. |
| 5,498,219 | A | 3/1996 | Soufi |
| 5,540,188 | A | 7/1996 | Heinrichs |
| 5,572,888 | A | 11/1996 | Browder |
| 5,766,114 | A | 6/1998 | Campbell |
| 6,095,613 | A | 8/2000 | Ostrander et al. |
| 6,125,792 | A | 10/2000 | Gee |

(Continued)

*Primary Examiner* — Oren Ginsberg

(74) *Attorney, Agent, or Firm* — Connie R. Masters

(57) ABSTRACT

An attendant-assisting baby walker that allows an attendant to remain upright while comfortably helping a baby to practice walking is provided. The attendant-assisting baby walker includes an open-top body suit with attached right and left support straps. The body suit includes both a torso-encircling component and a crotch component. The crotch front and back attach at or near the lower front and lower back edges of the torso-encircling component, respectively. The torso-encircling component is configured with a zipper, allowing fast and easy placement and positioning of the baby. The support straps are preferably adjustable to accommodate attendants of varying heights. Optionally, the torso-encircling component is configured with a width-adjustment mechanism, such as one or more cinches to improve the fit.

20 Claims, 7 Drawing Sheets

(56) References Cited

U.S. PATENT DOCUMENTS

| | | | | |
|---|---|---|---|---|
| 6,196,949 | B1 | 3/2001 | Rodarte | |
| 6,325,023 | B1 | 12/2001 | Elnatan | |
| 6,338,699 | B1 | 1/2002 | Veitch | |
| 6,361,478 | B1 | 3/2002 | Giancaspro | |
| 6,397,389 | B1 | 6/2002 | Schultz | |
| 6,836,902 | B2 | 1/2005 | Marquez et al. | |
| 6,910,993 | B1 | 6/2005 | Baran | |
| 6,968,809 | B2 | 11/2005 | Reardon | |
| 7,267,080 | B2 | 9/2007 | Gallo et al. | |
| 7,284,503 | B2 | 10/2007 | Elmberg | |
| 7,341,025 | B1 | 3/2008 | Streeter et al. | |
| 7,343,880 | B2 | 3/2008 | Bergkvist | |
| 2001/0027149 | A1 | 10/2001 | Bingham | |
| 2003/0207737 | A1* | 11/2003 | Sherman et al. | 482/69 |
| 2004/0045073 | A1* | 3/2004 | Marquez et al. | 2/69 |
| 2004/0221818 | A1 | 11/2004 | Rother et al. | |
| 2006/0278176 | A1 | 12/2006 | Chigirnskaya et al. | |
| 2007/0034163 | A1 | 2/2007 | Gallo et al. | |
| 2008/0018163 | A1 | 1/2008 | Winn et al. | |
| 2008/0121191 | A1 | 5/2008 | Wu | |
| 2010/0293694 | A1 | 11/2010 | Shah et al. | |
| 2014/0053789 | A1* | 2/2014 | Monroy | 119/770 |

* cited by examiner

ATTENDANT-ASSISTING BABY WALKER

CROSS-REFERENCE TO RELATED APPLICATION

This Continuation-in-Part Application claims the benefit of co-pending Non-Provisional Application No. 12/905,050 filed Oct. 14, 2010, which claims the benefit of U.S. Provisional Patent Application No. 61/251,745, filed on Oct, 15, 2009, which are incorporated herein in their entirety.

FIELD OF THE INVENTION

The present invention relates generally to baby accessories, and more particularly to an attendant-assisting baby walker that allows a parent or other attendant to assist a baby learning to walk by providing stability and support.

BACKGROUND INFORMATION

For a number of months before a baby learns to walk, he or she is interested in practicing the movements necessary for walking. Additionally, learning to walk is facilitated by exercise and by the strengthening of the appropriate muscles. To help the baby beginning walker maintain the proper upright walking posture while practicing taking steps and learning to walk, the parent (or other attendant) generally leans over to hold the hands of the baby or to support the baby under the arms. The parent supplies support both to keep the baby in the upright position and to stabilize the baby's steps for safety. As the parent is directly involved with the activity, the parent can judge the amount of aid the baby needs, providing support appropriate to the ever-changing ability of the beginning walker. Thus the parent can deliver a customized, enjoyable, optimal learning environment for the baby. However, repeatedly leaning over to assist and support a baby as he or she practices and exercises day after day can cause stress and strain on the back of the parent or attendant.

Several types of baby walker devices have been previously proposed, but each of these suffer from one or more disadvantages or limitations.

One type of device for helping a baby learn to walk merely provides two hand grips for the baby to grasp without any torso support, such as U.S. Pat. No. 4,907,972 issued to Marolda. Straps attach to the two hand grips, with the opposing end configured with loops or handholds for the parent to grasp. This type of baby walker suffers from a lack of safety, as a baby's grasping skills may not be adequate to support his or her weight; when the baby's grip loosens he or she may fall. Also, the developmental stage at which the baby has the ability to grasp the hand grips may come at a different time than the initial stages of practicing to walk. Accordingly, much of the benefit may be lost, as the need to practice walking may not overlap the development of gripping ability.

Another type of baby walker has only a chest band around the upper torso or a chest band plus shoulder bands. Straps are attached to the chest band, with the opposing end of each strap configured with a strap, loop, or hand grip for the parent to grasp. This type is exemplified by U.S. Pat. No. 1,749,999 issued to Crocker; U.S. Pat. No. 5,540,188 issued to Heinrichs; U.S. Pat. No. 5,476,070 issued to Gwon; and U.S. Pat. No. 7,267,080 issued to Gallo, plus U.S. Patent Application Publications No. 2008/0121191 filed by Wu and No. 2004/0221818 filed by Rother. Other, similarly constructed devices used for sports training or safety include the safety harness of U.S. Pat. No. 3,992,040; the ski-training band of U.S. Pat. No. 5,074,795; and the sport training devices of U.S. Pat. Nos. 6,338,699; 6,361,478; and 6,125,792.

This chest-band type baby (or child) assistive device has a limited ability to distribute pressure. Consequently it may place undue pressure on the baby's chest or underarm area, especially if the baby trips or falls, so that the full weight of the baby will be placed on the generally narrow band. Also, the straps by which the parent supports the baby are generally positioned at a rearward location of the chest band. Thus, the parent cannot exert an even upward force to assist the baby in maintaining the proper upright posture or to prevent the baby from falling. Additionally, the baby may strain forward to offset the backward pressure necessarily applied. If the parent reduces or releases the backward pressure, the baby may be overbalanced and can tumble forward.

Another type of baby walker has both an upper torso band and a lower torso or crotch support, providing better pressure distribution. However, currently available devices of this type still have disadvantages. Some devices of this type (such as U.S. Pat. Nos. 5,120,287; 6,968,809; 6,325,023; 4,981,110; and 6,095,613) have a thin crotch strap, which does not distribute the pressure well or evenly, so is not comfortable for the child. Other devices with lower torso support have two thin crotch straps positioned at the joint between the upper inner thighs and the body (such as U.S. Pat. Nos. 5,435,272 and 7,341,025); these cause undue pressure at the inner upper thigh and may cause skin chafing. Additionally, some of the devices of this type (such as U.S. Pat. Nos. 5,388,551 and 6,397,389; U.S. patent applications Ser. No. 2006/0278176 and No. 2008/0018163) have complex strap and buckling systems, making it tedious and time-intensive to place the baby within and to adjust. As a baby walking exercise may be of only a short duration, this is particularly inconvenient.

Accordingly, there is an established need for a practical, convenient attendant-assisting baby walker that provides increased comfort, increased safety, and allows the attendant to exert an even upward force, thereby assisting the baby in maintaining the proper upright posture.

SUMMARY OF THE INVENTION

The present invention is directed to an attendant-assisting baby walker that conveniently and safely allows a baby to practice walking and to strengthen the walking muscles while supported in a proper upright walking posture and that allows the parent or attendant to remain upright thereby reducing strain on the lower back.

The attendant-assisting baby walker includes an open-top body suit with attached right and left support straps. The body suit includes both a torso-encircling component and a crotch component.

The crotch front and back attach at or near the lower front and lower back edges of the torso-encircling component, respectively. The torso-encircling component is configured with a zipper, allowing fast and easy placement and positioning of the baby within the baby walker. The torso-encircling component is also configured with a width-adjustment mechanism, such as one or more mid-section cinches, to allow the parent to manually adjust the upper portion of the torso-encircling component to fit the baby.

The support straps are preferably adjustable to accommodate attendants of varying heights. The attendant-assisting baby walker increases safety and comfort for both the baby and the attendant.

Optionally, handholds may be positioned on the support straps for the comfort of the attendant.

An object of the present invention is to provide an attendant-assisting baby walker that is usable to assist a baby in learning the movements involved in walking.

Another object of the present invention is to provide an attendant-assisting baby walker that is usable to assist a baby in strengthening the muscles used in walking.

A further object of the present invention is to provide an attendant-assisting baby walker that allows a parent or other attendant to stand substantially upright when assisting a baby to practice walking.

Another object of the present invention is to provide an attendant-assisting baby walker that is adjustable to accommodate attendants of varying heights.

An additional object of the present invention is to provide an attendant-assisting baby walker that is configured to allow quick and easy placement and positioning of the baby within the attendant-assisting baby walker.

A further object of the present invention is to provide an attendant-assisting baby walker that is configured to provide comfortable support for the baby.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION

Shown throughout the figures, the present invention is directed toward a convenient and practical attendant-assisting baby walker that allows a baby to safely practice walking with aid from a parent or other attendant. The attendant can assist the baby in learning to walk by helping the baby to remain in the correct upright posture and by supporting a portion of the baby's weight; yet the attendant is able to remain substantially erect, thereby preventing back strain and increasing the enjoyment of the activity. (Throughout the description of the invention, the person supporting the baby is referred to as an "attendant." This term is meant to include any person capable of supporting the baby, such as a parent, grandparent, child-care worker, nanny, au pair, older sibling, or the like.)

Figure 1:
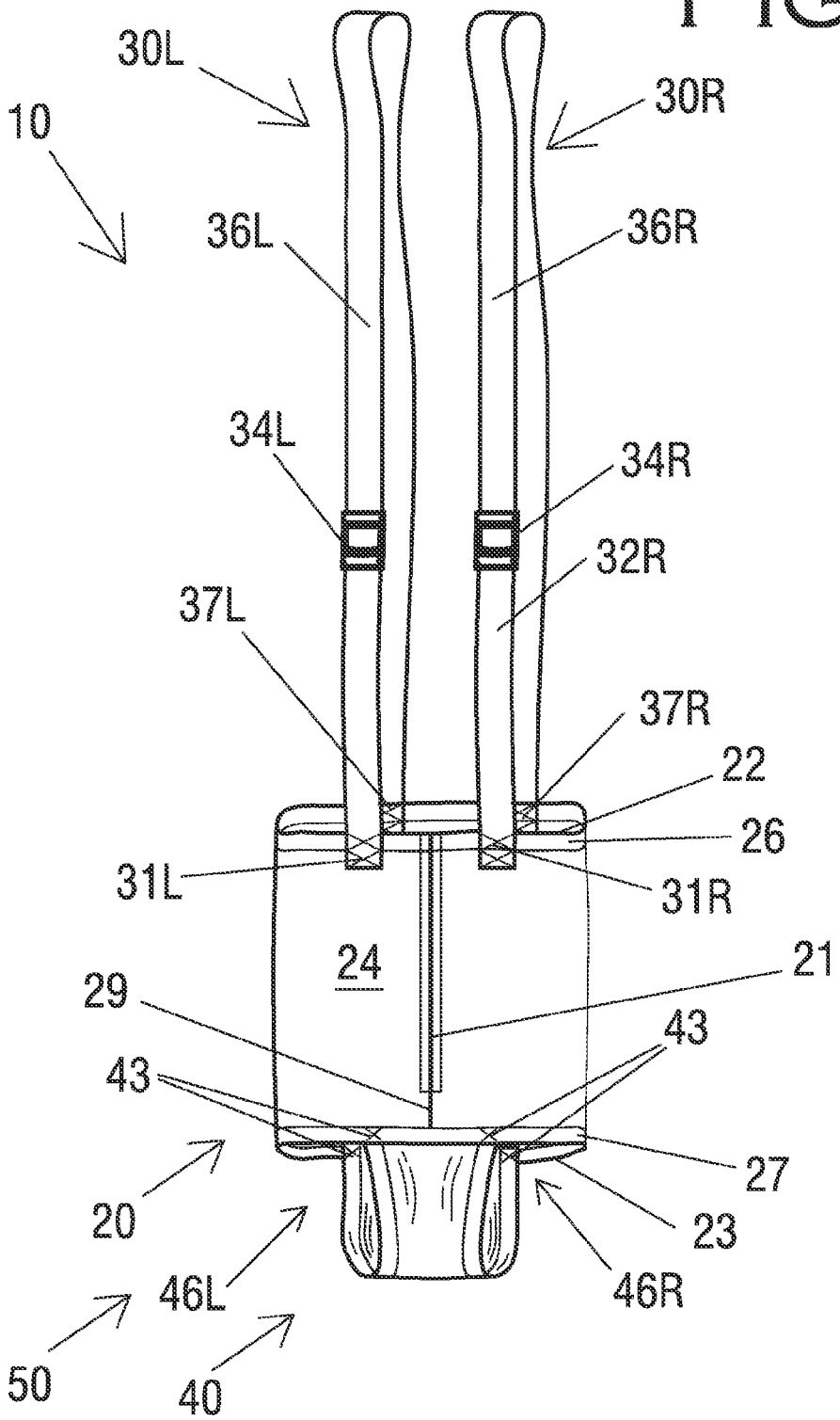
FIG. 1 is a front perspective view showing a first embodiment of the attendant-assisting baby walker of the present invention.
Figure 2:
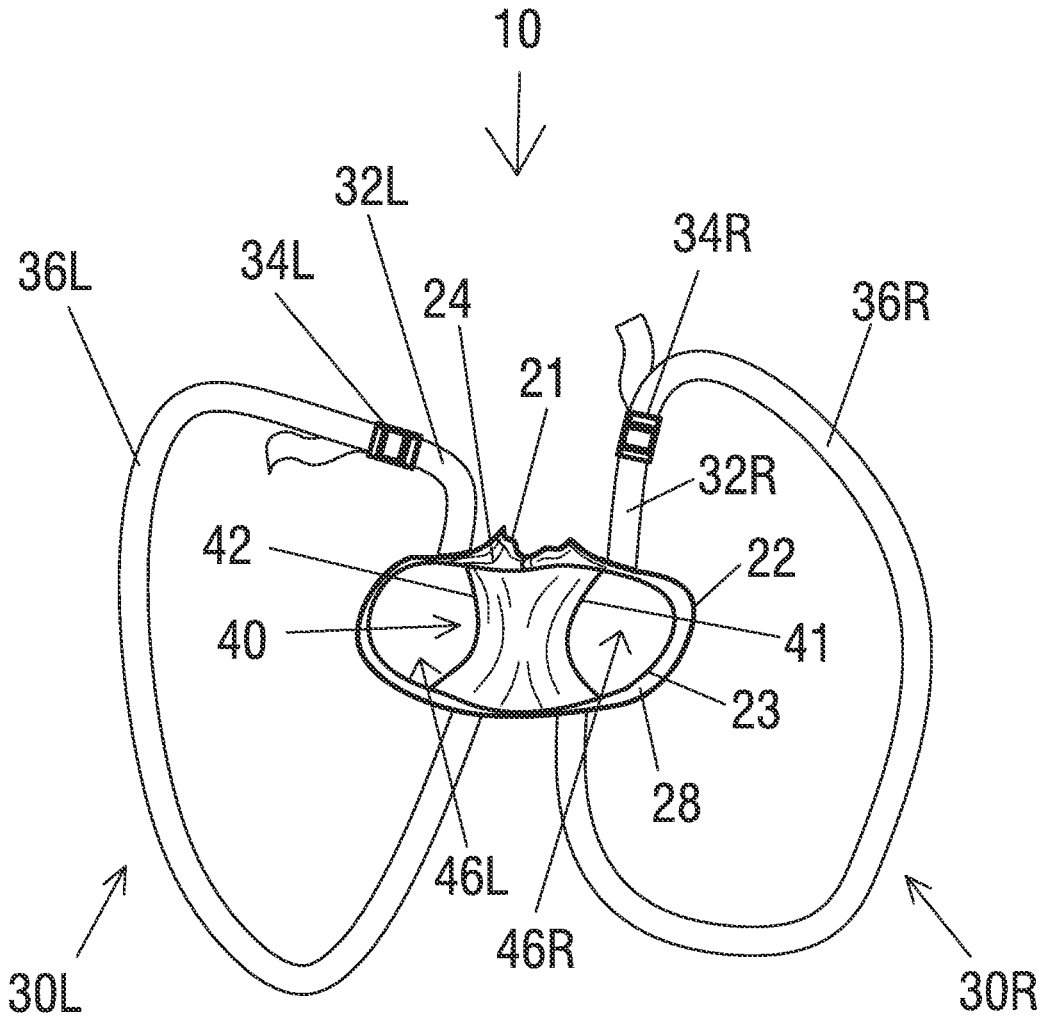
FIG. 2 is a top view showing the first embodiment of the attendant-assisting baby walker of the present invention.
Figure 3:
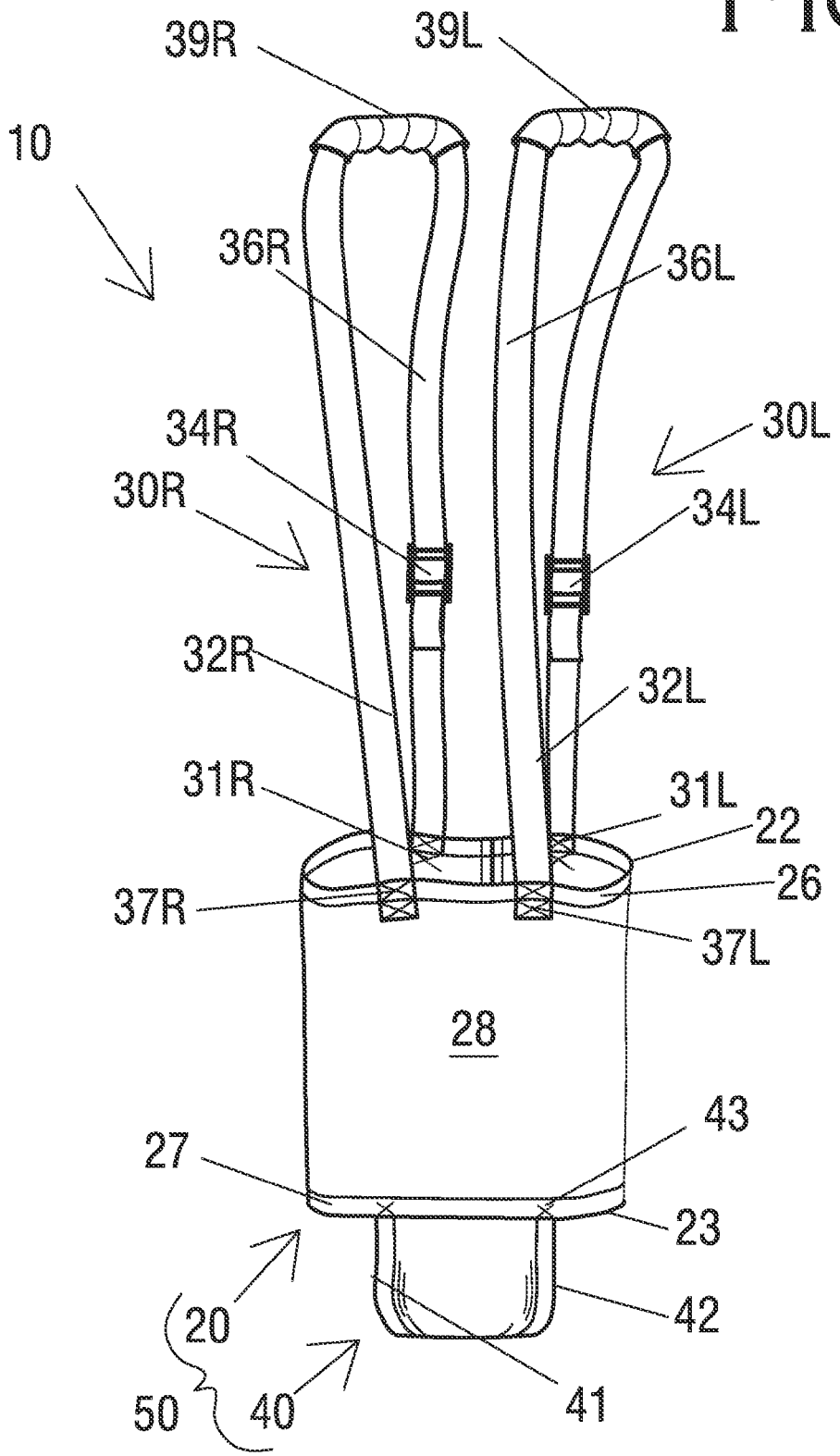
FIG. 3 is a back perspective view showing a first alternate aspect (handholds for the attendant) of the first embodiment of the attendant-assisting baby walker of the present invention.
Figure 8:
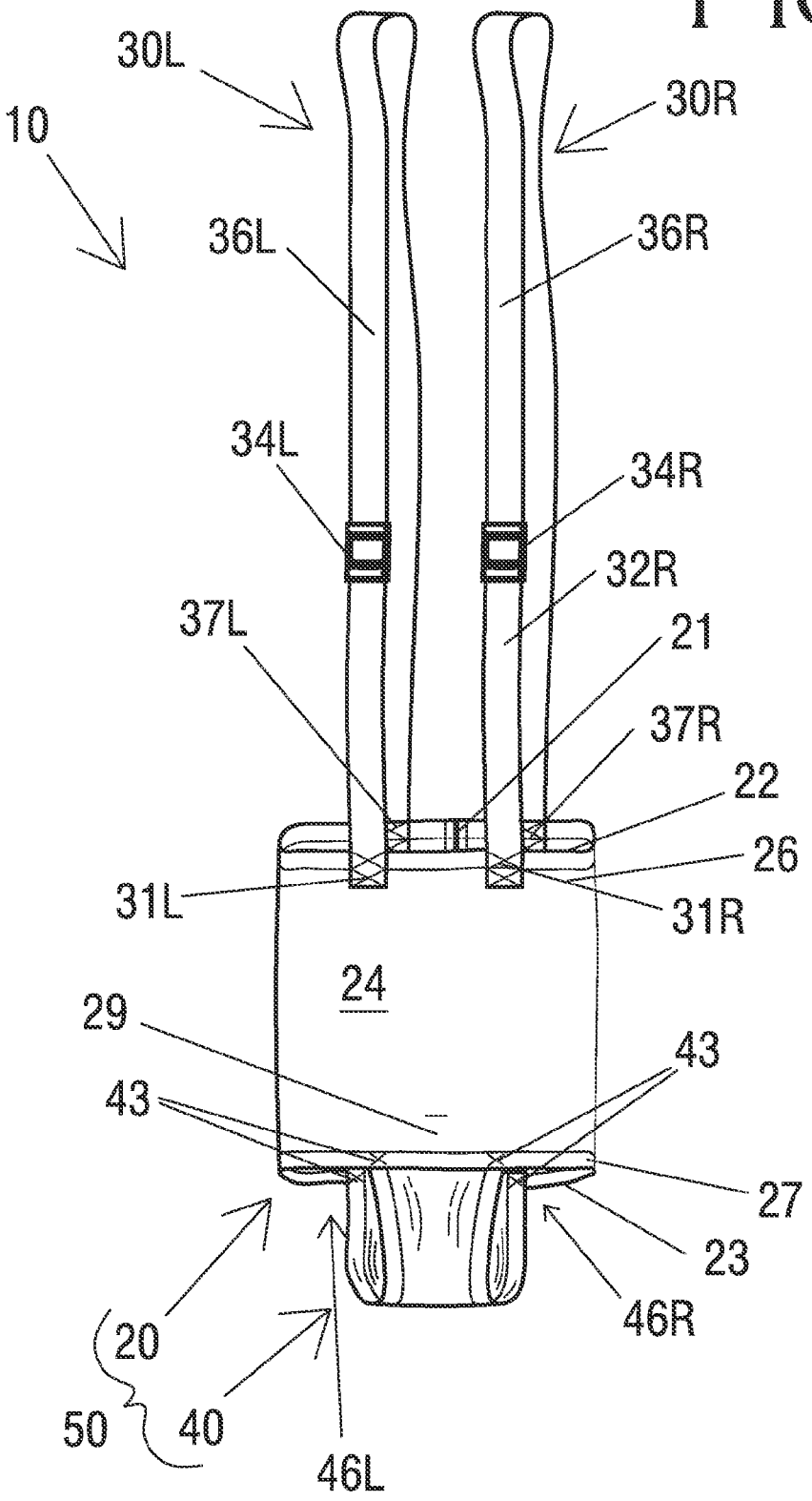
FIG. 8 is a front perspective view showing a second embodiment of the attendant-assisting baby walker of the present invention, which is usable with any of the handholds of the alternate aspects.
Figure 9:
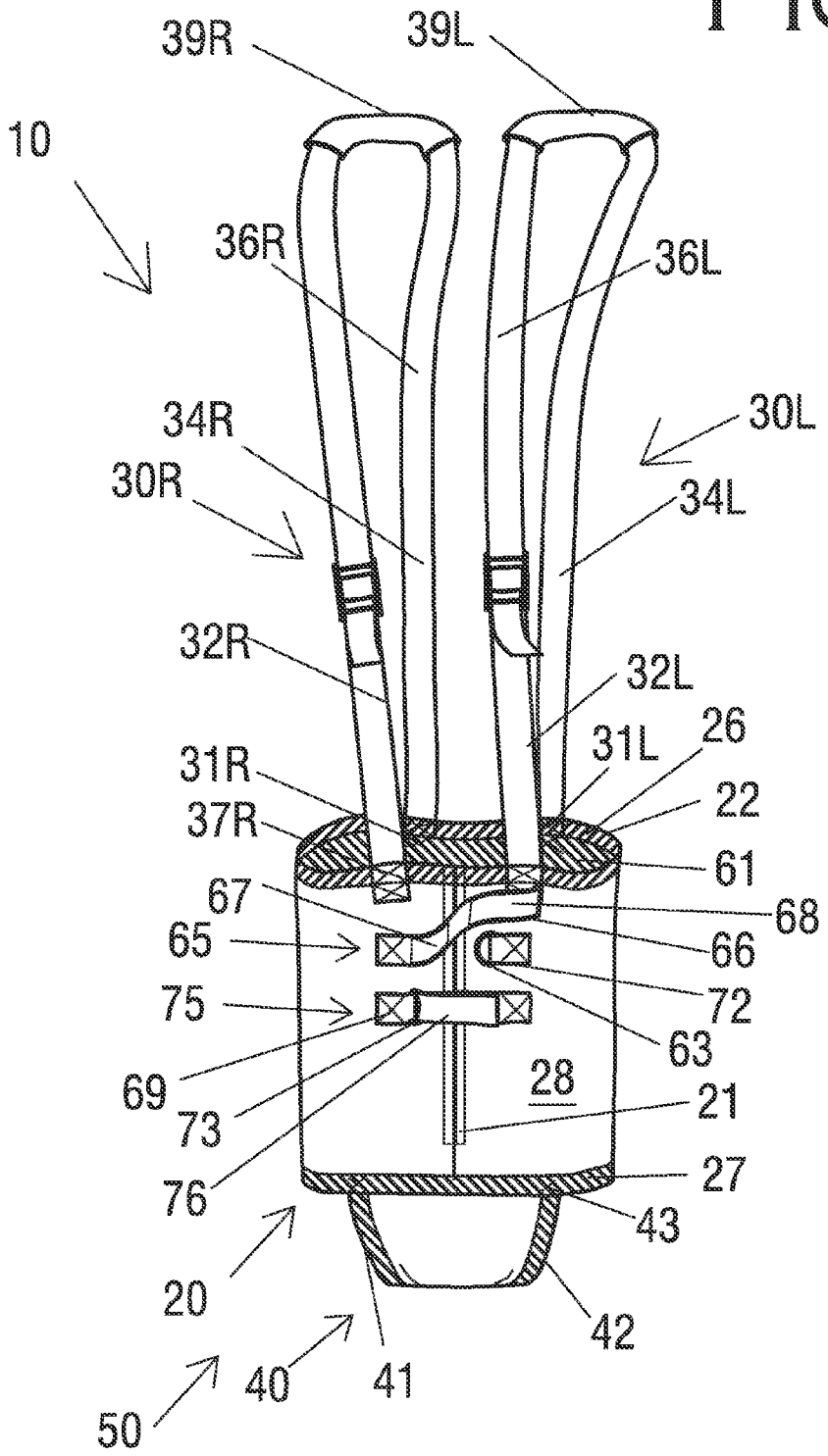
FIG. 9 is a back perspective view showing a third preferred embodiment of the attendant-assisting baby walker of the present invention with a back zipper, two mid-section cinches, and the attendant handholds of the fifth alternate aspect.

Three embodiments are presented, the first embodiment of FIG. 1 to FIG. 3 configured with a front zipper, the second embodiment of FIG. 8 configured with a back zipper, and the third embodiment of FIG. 9 with a back zipper, a width-adjustment mechanism shown as two mid-section cinches, and the attendant handholds of the fifth alternate aspect. Alternate aspects are also presented, including optional handholds and a supportive cross-strap.

Referring now to the front view of FIG. 1 and to the back view of FIG. 3, an attendant-assisting baby walker, shown generally as reference number 10, is illustrated in accordance with a first embodiment of the present invention. As shown, the attendant-assisting baby walker 10 includes an open-top body suit 50 with attached right and left support straps 30R, 30L. The body suit 50 comprises an upper torso-encircling component 20 with an attached lower crotch component 40.

The torso-encircling component 20 is generally in the shape of a hollow cylinder with an open top and bottom, with the crotch component 40 partially closing the bottom of the torso-encircling component 20 to form lateral leg holes 46R, 46L. The torso-encircling component 20 of the first embodiment is preferably configured with a center front zipper 21. The baby is supported on the sides by the torso-encircling component 20 and at the bottom by the crotch component 40.

The open-top body suit 50 is preferably sized and configured to be comfortable and to be supportive for a baby who is beginning to learn to walk. The body suit 50 has a height sufficient to extend vertically from about the underarm area to the lower hip area of the baby, allowing the upper torso and arms of the baby to remain unrestrained above the upper edge 22. When the baby is placed in the attendant-assisting baby walker 10, the side of the body suit 50 extends downward to approximately the lower hip. The torso-encircling component 20 is not tightly fitted, yet is close-fitting enough to provide lateral support to the baby. The torso-encircling component 20 has a torso front 24, a torso back 28 (FIG. 3), and the vertically inset zipper 21.

Both the body suit 50 and the support straps 30R, 30L may be formed of natural or man-made flexible material having a sufficient strength to support the weight of the baby. The type of fabric (or fabrics) chosen may be dictated by considerations of durability, wash-ability, sturdiness, strength, and aesthetics. For example, nylon, cotton, rayon, polypropylene, neoprene, wool, polyester, blends, or other woven or non-woven material may be used. However, the body suit 50 is most preferably formed of a woven cotton canvas, and the support straps 30R, 30L most preferably are of nylon webbing.

Preferably torso front 24 and torso back 28 are formed integrally of a single piece of fabric joined at front seam 29 and zipper 21, but may alternatively be formed separately and joined at opposing side seams (not shown). Additional seams may be integrated into the basic body suit design to add interest or for aesthetic appeal, such as blocks of contrasting color or material. Also, decorative or ornamental elements may be added or incorporated into the body suit 50, such as an appliqué, decorative trim, printed graphic or text, or other embellishment.

Preferably the upper edge 22 and lower edge 23 are formed in such a manner as to provide a non-irritating boundary. For example, the material of the torso-encircling component 20 may be turned under and secured by sewing, thus producing a softer, rounded upper edge 22 and lower edge 23. Alternatively a cord may be incorporated within the interior of the upper edge 22 and lower edge 23 to increase the roundness of the edge for comfort and to add strength. Also, optionally, as illustrated, an upper-edge binding 26 and/or lower-edge binding 27 may be secured to cover the upper edge 22 and lower edge 23, respectively, thus preventing the raveling and abrading of the fabric, plus increasing the strength of the edges.

The torso-encircling component 20 of the body suit 50 of the first embodiment is configured with a front zipper 21, allowing fast and easy placement and positioning of the baby within the attendant-assisting baby walker 10. The zipper 21 is inset substantially in the center of the torso front 24 and extends from the upper edge 22 downward a sufficient length so that, when unzipped, a front opening is formed that is sufficiently large to allow convenient placement of the baby within the body suit. Preferably the zipper 21 extends downward at least three-fourths of the height of the body suit. The combination of the open top and the convenient relatively long front opening allow the baby to be quickly and easily placed within the attendant-assisting baby walker.

Crotch component 40 is preferably a single piece of fabric in a somewhat hourglass-shape. The front and back edges of crotch component 40 are non-removably attached to the lower front edge and lower back edge of the body suit 50, respectively, to form leg holes 46R, 46L, as best seen in the top view of FIG. 2. The attachment means used to non-removably attach crotch component 40 to torso-encircling component 20 is preferably stitching with a durable thread or filament, though other conventional means, such as, for example, rivets or adhesives, are within the scope of the invention. Additional reinforcement stitching 43 (FIG. 3) is preferably included for strength.

As shown, the back of crotch component 40 is preferably slightly wider than the front to provide a good body-conforming fit. The side edges 41, 42 of crotch component 40 are preferably finished with a binding or tape to strengthen and/or to decorate the raw edges 41, 42. The binding may be of a similar fabric and/or color or may be of different fabric and/or color.

Optionally, the upper edge 22, lower edge 23, side edge 41, and/or side edge 42 may be trimmed in a soft, fleecy material to increase comfort for the baby. Such a fleecy material may be a man-made fleece or a natural fleece, such as sheep skin.

The right and left support straps 30R, 30L are preferably adjustable to accommodate attendants of varying heights, although a support strap 30R, 30L having a non-adjustable length and formed of a single segment of strap material is within the scope of the invention. Right and left support straps 30R, 30L are thus preferably formed of right and left front strap segments 32R, 32L, right and left rear strap segments 36R, 36L, and right and left strap-adjustment mechanisms, such as the illustrated buckles 34R, 34L. The right buckle 34R is disposed between the right front strap segment 32R and right rear strap segment 36L in such a manner as to allow convenient adjustment. Correspondingly, the left buckle 34L is disposed between the left front strap segment 32L and left rear strap segment 36L. Right and left buckles 34R, 34L may be secured to either the front strap segments 32R, 32L, or to the rear strap segments 36R, 36L (with the opposing strap segment being threaded through the buckle) by any standard method, such as, for example, sewing or riveting. Most preferably the right and left buckles 34R, 34L are positioned to face the front of the attendant-assisting baby walker 10. Though buckles 34R, 34L are shown as the preferred strap-adjustment mechanisms, other adjustment mechanisms that allow easy, convenient adjustment of the length of the straps, such as complementary hook-and-loop fasteners, are within the scope of the invention.

The front strap segments 32R, 32L preferably are attached at or near the upper edge 22 of the torso front 24 via front strap attachment mechanisms 31R, 31L. Similarly, the rear strap segments 36R, 36L are attached at or near the upper edge 22 of the torso back 28 via back strap attachment mechanisms 37R, 37L. As illustrated, the location of attachment points of front strap segments 32R, 32L and back strap segments 36R, 36L are positioned to provide optimum comfort, safety, and positioning of the baby. The front strap attachment mechanisms 31R, 31L are spaced somewhat to the sides of the front zipper 21, while the back strap attachment mechanisms 37R, 37L are spaced somewhat to the sides of the center of the torso back 28.

Front and back strap attachment mechanisms 31R, 31L, 37R, 37L may be any conventional means of permanently securing two pieces of material together. Front and back strap attachment mechanisms 31R, 31L, 37R, 37L may be, for example, stitching with a durable thread or filament, rivets, or adhesives. Optionally, the front strap attachment mechanisms 31R, 31L may be of one type (for example rivets, not shown), while the back strap attachment mechanisms 37R, 37L may be of a second type (for example, stitching); alternatively, as illustrated, both front and back strap attachment mechanisms 31R, 31L, 37R, 37L may be of the same type (for example, stitching). The front and back strap attachment mechanisms 31R, 31L, 37R, 37L may have an interior and exterior portion (such as when stitching or rivets are utilized, as illustrated) or the front and back strap attachment mechanisms 31R, 31L, 37R, 37L may not be viewable from either the interior or the exterior of the attendant-assisting baby walker 10 (such as when an adhesive is utilized).

Another aspect of the present invention is presented in FIG. 3, wherein the right and left support straps 30R, 30L further comprise a right handhold 39R and a left handhold 39L. The right and left handholds 39R, 39L are preferably movable and slide on the right and left support straps 30R, 30L, respectively; this allows the attendant to position the handholds 39R, 39L substantially at the top of the right and left support straps 30R, 30L when the attendant-assisting baby walker 10 is in use. The handholds 39R, 39L are configured to negate the discomfort of the supported weight. Handholds 39R, 39L of this first aspect are preferably rounded and ergonomically designed of a plastic material.

Four other exemplary types of handholds 39R, 39L are illustrated in FIG. 4, FIG. 5, FIG. 6, and FIG. 7.

Figure 4:
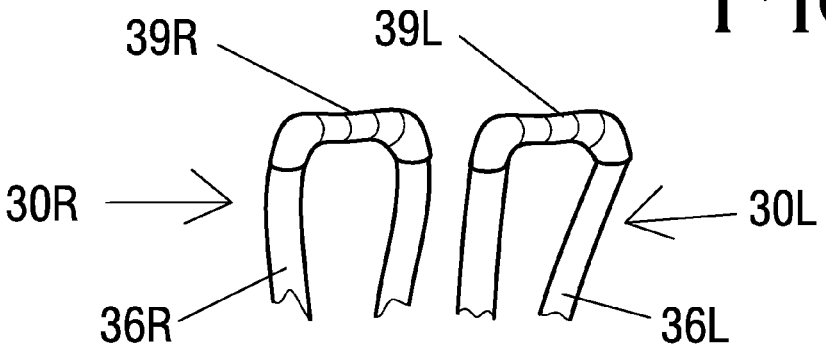
FIG. 4 is a partial perspective view showing a second alternate aspect (handholds for the attendant) of the first embodiment of the attendant-assisting baby walker of the present invention.

FIG. 4 shows a second exemplary handhold aspect of the present invention with handholds 39R, 39L preferably rounded and ergonomically designed, but non-movably attached to the support straps 30R, 30L.

Figure 5:
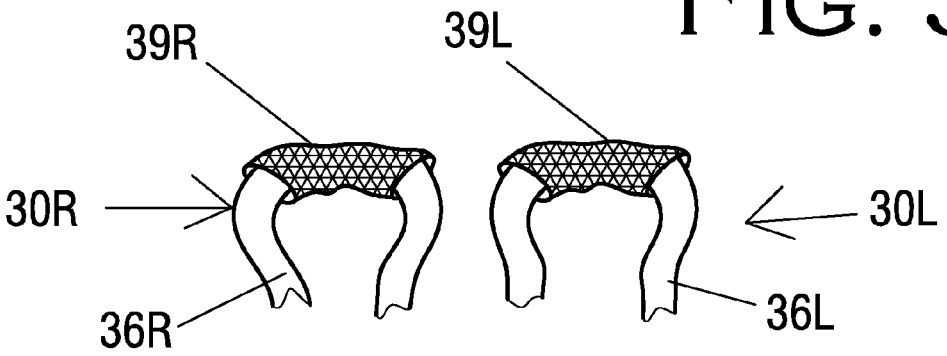
FIG. 5 is a partial perspective view showing a third alternate aspect (handholds for the attendant) of the first embodiment of the attendant-assisting baby walker of the present invention.

FIG. 5 shows a third exemplary handhold aspect of the present invention with handholds 39R, 39L configured to slide on the support straps 30R, 30L. The handholds 39R, 39L of FIG. 5 are preferably a machine-washable, soft, fleecy material, which not only provides a cushion for the comfort of the attendant, but also may be easily removed from support straps 30R, 30L by disengaging the right and left front strap segments 32R, 32L from the right and left rear strap segments 36R, 36L by means of the buckles 34R, 34L. After removal the handholds 39R, 39L can be machine washed and dried and replaced.

Figure 6:
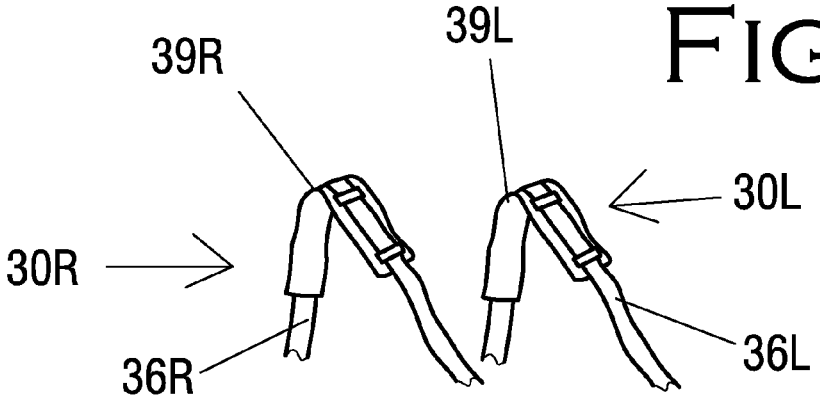
FIG. 6 is a partial perspective view showing a fourth alternate aspect (handholds for the attendant) of the first embodiment of the attendant-assisting baby walker of the present invention.

FIG. 6 shows a fourth exemplary handhold aspect of the present invention with handholds 39R, 39L of a comfort-enhancing construction material, such as, for example, neoprene, which are interposed between the weight-supporting strap and the attendant's hands. The handholds 39R, 39L of the fourth aspect, may be positioned by sliding along the support straps 30R, 30L to a comfortable position.

Figure 7:
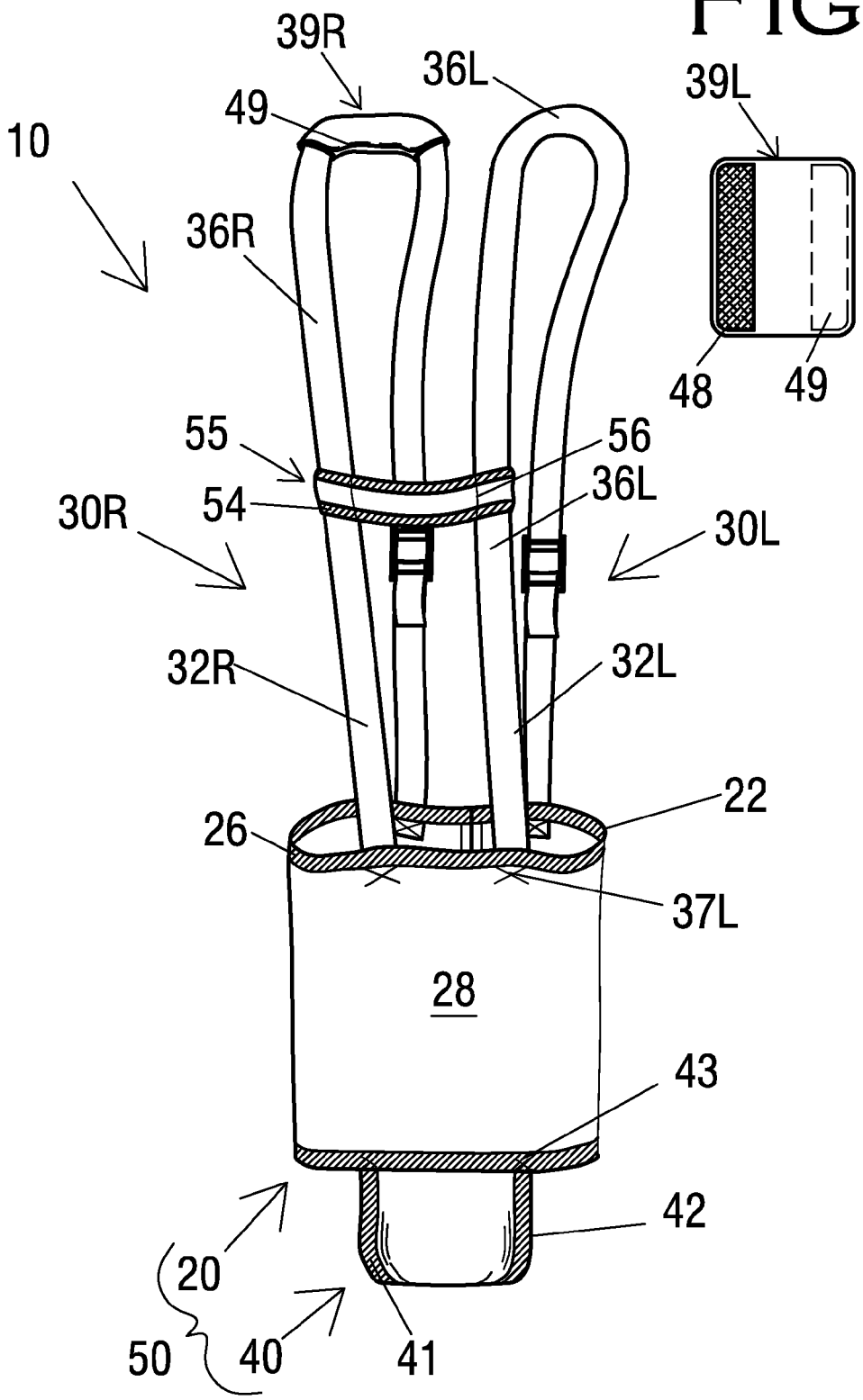
FIG. 7 is a back perspective view showing a fifth alternate aspect of the handholds for the attendant and an optional back cross-strap of the first embodiment of the attendant-assisting baby walker of the present invention.

FIG. 7 shows a fifth aspect of the handholds of the present invention with handhold 39R shown as engaged around support strap 39R and with handhold 39L in a flat, pre-engaged state. Handholds 39R, 39L are formed of a separate section of material approximately three times as wide as the support straps 30R, 30L. Handholds 39R, 39L are of sufficient width to be easily manually wrapped around the support straps 30R, 30L, respectively. The material forming the handholds may be hemmed to avoid raw edges and increase durability.

A first section 48 of complementary hook-and-loop-type fastener is disposed along a first longitudinal edge on the front side of handhold 39R, 39L, as illustrated. A second section 49 of complementary hook-and-loop-type fastener is disposed along the second longitudinal edge on the opposing back side of handhold 39R, 39L. After the handhold 39R, 39L is wrapped around the support strap 30R, 30L the first complementary hook-and-loop-type fastener section 48 is engaged with the second complementary hook-and-loop-type fastener section 49 on the opposing side. The handholds 39R, 39L may be positioned by sliding along the support straps 30R, 30L to a comfortable position. The fifth exemplary handhold aspect of the handholds 39R, 39L facilitates removal for cleaning or laundering without disengaging the buckles 34R, 34L.

FIG. 7 also illustrates an optional back cross-strap 55 that is configured to provide additional support and/or to hold the support straps 30R, 30L in an advantageous position for use. A portion of the back cross-strap 55 may be wrapped around the edge of support straps 30R, 30L and secured to support straps 30R, 30L via a cross-strap securing device, such as, for example, rivets or stitching 56.

FIG. 7 further illustrates one of numerous aesthetically-pleasing decorative options. The trim 54 of back cross-strap 55, the upper-edge binding 26, the lower-edge binding 27, and/or the trim of side edges 41, 42 may be of a contrasting color, texture, material, or the like. Optionally, logos, graphics, or other text can be easily embroidered onto the fabric of the torso-encircling component 20. Thus the attendant-assisting baby walker 10 may have one of numerous distinctive and/or customized styles or designs.

FIG. 8 illustrates a second exemplary embodiment of the attendant-assisting baby walker of the present invention. The baby walker of the second embodiment is functionally and structurally similar to the first embodiment of FIG. 1 and FIG. 2, with a variation in the placement of zipper 21. The zipper 21 of the second embodiment is placed in the back of the torso-encircling component 20. The back placement provides an uninterrupted front for comfort, as the top edge is smooth and unobstructed. In addition the back zipper provides security by removing access to the zipper from the child.

Preferably the torso-encircling component 20 of the baby walker is formed of a single piece of canvas fabric joined into the illustrated tubular form by the back zipper 21 in combination with a lower back seam.

FIG. 9 illustrates a third preferred exemplary embodiment of the attendant-assisting baby walker of the present invention. The baby walker of the third embodiment is functionally and structurally similar to the second embodiment of FIG. 8 with the addition of a full lining and a width-adjustment mechanism, such as at least one mid-section cinch 65, 75. The mid-section cinch or cinches 65, 75 allow the attendant to adjust the waist area to accommodate a variation in the size of the child. The third embodiment utilizes the wraparound-type attendant handholds 39R, 39L of the fifth alternate aspect.

As in the second embodiment, the torso-encircling component 20 of the baby walker is preferably formed of a single piece of canvas fabric joined into a tubular form by the back zipper 21 in combination with a lower back seam. In addition, however, a full lining 61 is included in the third embodiment. A soft material is preferably used for lining 61, which may provide additional comfort for the baby and enhanced absorbency. The soft material of lining 61 may be soft velour, flannel, felt, velvet, plush fabric, fleece, or the like. The upper-edge binding 26 and/or lower-edge binding 27 are preferably formed of the same soft fabric for the comfort of the baby and for aesthetics. The lining 61 lines the interior of the canvas material, preferably being sewn as a double layer of fabric bound by the upper-edge binding 26 and/or lower-edge binding 27.

The two mid-section cinches 65, 75 are disposed at the back of the walker 10 and extend across the zipper 21. They are attached on the upper half of the torso-encircling component 20. The two mid-section cinches 65, 75 are formed of two sections, one section on each side of zipper 21. A first section 72 of each of the two mid-section cinches 65, 75 is sewn with stitching 69 onto the material of the torso-encircling component 20 a short distance away from the edge of the zipper 21; the opposing second section 66, 76 of each of the two mid-section cinches 65, 75 is sewn with stitching 69 onto the material of the torso-encircling component 20 a short distance away from the opposing edge of the zipper 21. The corresponding first and second sections are generally horizontally aligned. Preferably the first section 72 of each of the two mid-section cinches 65, 75 secures a D-ring 63, 73 and the opposing second section 66, 76 is a long, narrow band configured with a complementary set of hook-and-loop fasteners 67, 68 to loop into the D-ring 63, 73 and fold back upon itself. The band 66 is shown as not engaged, but engageable, in D-ring 63, and the band 76 is shown engaged in D-ring 73. The unengaged cinch 65 also shows the disposition of complementary hook-and-loop fasteners 67, 68. Though not visible in the illustration, band 76 is similarly configured with complementary hook-and-loop fasteners. The D-ring 63, 73 is sized to accommodate the band 66, 76. The band 66, 76 is sufficiently long to approximately double onto itself to allow the first hook-and-loop fastener 67 to attach to the complementary hook-and-loop fastener 68.

The attendant can adjust one or both of the cinches 65, 75 to achieve a desired fit. Preferably the cinches 65, 75 may be turned in opposite directions, with the D-ring 63 of one cinch turned in the opposing direction to the D-ring 73 of the other cinch. This reduces bulk and may allow for a more compact folding of the walker 10.

The attendant-assisting baby walker 10 has been herein described as sized for a baby learning to walk. For a baby of this size, the circumference of the torso-encircling component 20 may be from 20-24 inches, preferably approximately 22 inches. The height of the torso-encircling component 20, from upper edge 22 to lower edge 23, may be from 6 to 10 inches, and is preferably approximately 8 inches. The support straps 30R, 30L are preferably approximately 36-44 inches long.

Optionally, although the attendant-assisting baby walker 10 has been herein described for a baby learning to walk, the attendant-assisting baby walker 10 can be easily manufactured in a somewhat larger size to allow a parent to support a child learning to do any of a variety of athletic activities in which training support may be desired. These athletic activities would include, for example, skating, skiing, or the like.

To use the attendant-assisting baby walker 10 of the present invention, the attendant may adjust the buckles 34R, 34L, if needed to lengthen or shorten the right and left support straps 30R, 30L. The zipper 21 is unzipped (FIG. 2), if not already in the unzipped state. The attendant then places the legs of the baby within the leg holes 46R, 46L, positioning the baby comfortably within the body suit 50. The attendant then holds the right and left support straps 30R, 30L in his or her right and left hands and supports the baby with an adequate amount of support, as required by the abilities of the baby. (Optionally, if handholds 39R, 39L are included, the attendant may position the handholds 39R, 39L in a comfortable position along support straps 30R, 30L and hold onto the handholds 39R, 39L.) If the cinches 65, 75 are included on the device, the attendant can adjust one or both of the cinches 65, 75 and engage them to achieve a proper fit. The attendant then supports the baby within the walker 10, offering the needed amount of support to deliver a personalized, enjoyable, optimal learning environment for the baby.

From the foregoing, it will be apparent that the attendant-assisting baby walker 10 of the current invention provides a convenient device for an attendant to assist a baby in learning to walk and in strengthening the muscles used in walking.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A device for assisting a baby to walk, consisting of:

an open-top body suit comprising a crotch component, a torso-encircling component, and at least one mid-section cinch; wherein said crotch component is non-removably joined to said torso-encircling component; wherein said torso-encircling component is configured with a vertically disposed zipper; wherein said torso-encircling component is formed into a tubular shape by a lower seam in combination with said zipper; wherein said torso-encircling component includes a torso upper edge and a torso lower edge; wherein said at least one mid-section cinch is configured to reduce the circumference of said torso-encircling component; and wherein said body suit has a height of between six and ten inches from said torso upper edge to said torso lower edge;

a right support strap having opposing ends attached to an upper front area and an upper rear area, respectively, of said torso-encircling component;

a left support strap having opposing ends attached to an upper front area and an upper rear area, respectively, of said torso-encircling component.

2. The device for assisting a baby to walk, as recited in claim 1, further comprising:

a left strap-adjustment mechanism configured to adjust the length of said left support strap; and a right strap-adjustment mechanism configured to adjust the length of said right support strap.

3. The device for assisting a baby to walk, as recited in claim 2, wherein:

said left strap-adjustment mechanism comprises a left buckle; and said right strap-adjustment mechanism comprises a right buckle.

4. The device for assisting a baby to walk as recited in claim 1, further comprising:

a right handhold slidingly engaged upon said right support strap; and a left handhold slidingly engaged upon said left support strap.

5. The device for assisting a baby to walk as recited in claim 1, wherein said zipper is disposed in said front area of said torso-encircling component.

6. The device for assisting a baby to walk as recited in claim 1, wherein said zipper is disposed in said rear area of said torso-encircling component.

7. The device for assisting a baby to walk as recited in claim 1, wherein:

said torso-encircling component comprises a canvas fabric;

said crotch component comprises a canvas fabric;

said left support strap comprises webbing; and said right support strap comprises webbing.

8. The device for assisting a baby to walk as recited in claim 1, wherein:

said torso-encircling component comprises a first outer fabric and a first inner fabric lining configured to fully line said first outer fabric; and said crotch component comprises a second outer fabric and a second inner fabric lining configured to fully line said first outer fabric.

9. The device for assisting a baby to walk as recited in claim 8, wherein:

said first outer fabric is a canvas fabric;

said first inner lining is a flannel fabric;

said second outer fabric is a canvas fabric;

said second inner lining is a flannel fabric.

10. The device for assisting a baby to walk as recited in claim 1, wherein:

said crotch component is configured with a finished crotch left edge and a finished crotch right edge;

said crotch component has a crotch front edge joined to a lower front area of said torso-encircling component;

said crotch component has a crotch back edge joined to a lower back area of said torso-encircling component; and said crotch back edge is wider than said crotch front edge.

11. The device for assisting a baby to walk as recited in claim 10, wherein:

said crotch front edge is joined to said lower front area of said torso-encircling component by sewing; and said crotch back edge is joined to said lower back area of said torso-encircling component by sewing.

12. The device for assisting a baby to walk as recited in claim 11, wherein:

said finished crotch left edge is trimmed with flannel fabric;

said finished crotch right edge is trimmed with flannel fabric;

said torso upper edge is trimmed with flannel fabric; and said torso lower edge is trimmed with flannel fabric.

13. The device for assisting a baby to walk as recited in claim 1 wherein said at least one mid-section cinch comprises two mid-section cinches, each of which comprises a first section and a second section; wherein said first section comprises a long, narrow band having an attached first portion of hook-and-loop fastener and an attached second portion of complementary hook-and-loop fastener; wherein said second section comprises a shorter narrow band securing a D-ring; and wherein said first section is configured to be manually wrapped through said D-ring and looped upon itself in such a manner that said first portion of hook-and-loop fastener is manually engageable with said second portion of said complementary hook-and-loop fastener.

14. The device for assisting a baby to walk as recited in claim 13 wherein:

a first one of said two mid-section cinches is attached horizontally with a first one of said second section attached on the right side of said zipper; and a second one of said two mid-section cinches is attached horizontally in an opposing orientation with a second one of said second section attached on the left side of said zipper.

15. A device for assisting a baby to walk, consisting of:

an open-top body suit consisting of a crotch component non-removably attached to a torso-encircling component; wherein said crotch component is configured with a crotch front edge and a crotch back edge; wherein said crotch back edge is wider than said crotch front edge; wherein said torso-encircling component is configured with a vertically disposed central back zipper, with a torso upper edge, and with a torso lower edge; and wherein said body suit has a height of between six and ten inches from said torso upper edge to said torso lower edge;

an adjustable right support strap having opposing ends attached to an upper right front area and an upper right rear area, respectively, of said torso-encircling component; wherein said right support strap is configured with a right buckle operable to adjust the length of said right support strap; and a left support strap having opposing ends attached to an upper left front area and an upper left rear area, respectively, of said torso-encircling component; and wherein said left support strap is configured with a left buckle operable to adjust the length of said left support strap.

16. The device for assisting a baby to walk as recited in claim 15, wherein:

said torso-encircling component comprises a single piece of canvas fabric lined with a separate single piece of flannel fabric, which are together joined into a tubular form by said zipper in combination with a lower seam; and said crotch component comprises a single piece of canvas fabric lined with a separate single piece of flannel fabric.

17. The device for assisting a baby to walk as recited in claim 15, wherein:

said torso-encircling component comprises a first outer fabric and a first inner fabric lining configured to fully line said first outer fabric.

18. The device for assisting a baby to walk as recited in claim 15, wherein said open-top body suit further consists of two mid-section cinches, each of which comprises a first section and a second section; wherein said first section comprises a long, narrow band having an attached first portion of hook-and-loop fastener and an attached second portion of complementary hook-and-loop fastener; wherein said second section comprises a shorter narrow band securing a D-ring; and wherein said first section is configured to be manually wrapped through said D-ring and looped upon itself in such a manner that said first portion of hook-and-loop fastener is manually engageable with said second portion of said complementary hook-and-loop fastener.

19. The device for assisting a baby to walk as recited in claim 18 wherein:

a first one of said two mid-section cinches is attached horizontally with a first one of said second section attached on the right side of said zipper; and a second one of said two mid-section cinches is attached horizontally in an opposing orientation with a second one of said second section attached on the left side of said zipper.

20. A device for assisting a baby to walk, consisting of:

an open-top body suit comprising a crotch component, a torso-encircling component formed of canvas fabric and a full flannel fabric lining, and two mid-section cinches; wherein said crotch component is non-removably joined to said torso-encircling component; wherein said torso-encircling component is configured with a vertically disposed zipper; wherein said torso-encircling component is formed into a tubular shape by a lower seam in combination with said zipper; wherein said torso-encircling component includes a torso upper edge and a torso lower edge; wherein said at least one mid-section cinch is configured to reduce the circumference of said torso-encircling component; and wherein said body suit has a height of between six and ten inches from said torso upper edge to said torso lower edge;

a right and a left support strap each having opposing ends attached to an upper front area and an upper rear area, respectively, of said torso-encircling component;

a left and right strap-adjustment mechanism configured to adjust the length of said left and right support straps, respectively;

a right and left handhold slidingly engaged upon said right and left support straps, respectively; wherein said at least one mid-section cinch comprises two mid-section cinches, each of which comprises a first section and a second section; wherein said first section comprises a long, narrow band having an attached first portion of hook-and-loop fastener and an attached second portion of complementary hook-and-loop fastener; wherein said second section comprises a shorter narrow band securing a D-ring; wherein said first section is configured to be manually wrapped through said D-ring and looped upon itself in such a manner that said first portion of hook-and-loop fastener is manually engageable with said second portion of said complementary hook-and-loop fastener.

* * * * *